US008851040B2

(12) United States Patent
Kim et al.

(10) Patent No.: US 8,851,040 B2
(45) Date of Patent: Oct. 7, 2014

(54) IGNITION COIL OF ENGINE

(75) Inventors: Ji Hyoung Kim, Incheon (KR); Jong Wook Lee, Gyeonggi-do (KR); Kyung Sick Cho, Chungcheongnam-do (KR); Ki Su Lim, Chungcheongnam-do (KR)

(73) Assignees: Hyundai Motor Company, Seoul (KR); YuraTech Co., Ltd., Yeongi-Gun, Chungcheongnam-Do (KR)

( * ) Notice: Subject to any disclaimer, the term of this patent is extended or adjusted under 35 U.S.C. 154(b) by 1117 days.

(21) Appl. No.: 12/797,034

(22) Filed: Jun. 9, 2010

(65) Prior Publication Data

US 2011/0126811 A1 Jun. 2, 2011

(30) Foreign Application Priority Data

Dec. 1, 2009 (KR) ..... 10-2009-0117782

(51) Int. Cl.

| | |
|---|---|
| ***F02P 3/04*** | (2006.01) |
| ***H01F 38/12*** | (2006.01) |
| *F02P 11/00* | (2006.01) |
| *F02P 13/00* | (2006.01) |
| *H01T 13/06* | (2006.01) |
| *F02P 3/02* | (2006.01) |

(52) U.S. Cl.

CPC ..... *H01F 38/12* (2013.01); *F02P 11/00* (2013.01); *F02P 13/00* (2013.01); *H01T 13/06* (2013.01); *F02P 3/02* (2013.01)

USPC ..... 123/143 C; 123/621; 123/655

(58) Field of Classification Search

CPC ..... H01T 13/06; H01T 13/18; H01F 38/12; F02P 3/04

USPC ..... 123/143 A, 143 B, 621, 624, 633, 634, 123/655, 656

See application file for complete search history.

(56) References Cited

U.S. PATENT DOCUMENTS

| | | | | |
|---|---|---|---|---|
| 6,378,514 | B1 * | 4/2002 | Kaminaga et al. | 123/633 |
| 6,639,498 | B2 * | 10/2003 | Shimada et al. | 336/96 |
| 7,387,115 | B1 * | 6/2008 | Katoh et al. | 123/620 |
| 8,033,273 | B2 * | 10/2011 | Kato et al. | 123/596 |
| 2004/0069288 | A1 * | 4/2004 | Shimada et al. | 123/635 |
| 2006/0129890 | A1 * | 6/2006 | Shimada et al. | 714/36 |
| 2007/0039599 | A1 * | 2/2007 | Skinner et al. | 123/647 |
| 2008/0149083 | A1 * | 6/2008 | Katoh et al. | 123/634 |
| 2011/0132338 | A1 * | 6/2011 | Kim et al. | 123/634 |
| 2012/0053818 | A1 * | 3/2012 | Sackmann et al. | 701/102 |

FOREIGN PATENT DOCUMENTS

| | | | |
|---|---|---|---|
| CN | 1132311 | A | 10/1996 |
| CN | 1142009 | A | 2/1997 |
| CN | 1257603 | A | 6/2000 |
| JP | H8-121309 | A | 5/1996 |
| JP | 2006-286692 | A | 10/2006 |

OTHER PUBLICATIONS

Office Action for corresponding Chinese Application Ser. No. 201010215335.7, Jun. 4, 2014 (14 pages).

* cited by examiner

*Primary Examiner* — Hieu T Vo
*Assistant Examiner* — Sherman Manley
(74) *Attorney, Agent, or Firm* — Edwards Wildman Palmer LLP; Peter F. Corless

(57) ABSTRACT

The present invention features an ignition coil of an engine, in which a small condenser is directly installed to an LV pin of the ignition coil, thus effectively removing noise, and dissipating heat from the ignition coil to an outside, in addition to preventing the inflow of water.

8 Claims, 2 Drawing Sheets

IGNITION COIL OF ENGINE

CROSS-REFERENCE TO RELATED APPLICATION

This application claims under 35 U.S.C. §119(a) the benefit of Korean Patent Application No. 10-2009-0117782 filed Dec. 1, 2009, the entire contents of which are incorporated herein by reference.

BACKGROUND OF THE INVENTION

1. Field of the Invention

The present invention relates, in general, to ignition coils of engines and, more particularly, to an ignition coil of an engine, which is capable of effectively removing noise from the ignition coil and suitably preventing the inflow of water, in addition to suitably dissipating heat from the ignition coil to an outside.

2. Description of the Related Art

In general, an ignition coil of an engine for a vehicle functions to supply high voltage to spark plugs in the engine, and is mounted to a head cover of the engine and connected to the spark plugs installed in a combustion chamber.

For example, a 4-cylinder engine is described with reference to FIG. 1. Preferably, the 4-cylinder engine requires four ignition coils 10. A wiring harness 20 is suitably connected to a connector 11 of each ignition coil 10, and an end of the wiring harness 20 is suitably connected to a connector 30 equipped with a condenser 40.

Here, the condenser 40 is suitably provided to remove noise from the ignition coil 10. In the conventional condenser, the distance between the ignition coil 10 and the condenser 40 is long, so that it can be difficult to effectively remove noise.

Accordingly, there is a need in the art for improved ignition coils.

The above information disclosed in this the Background section is only for enhancement of understanding of the background of the invention and therefore it may contain information that does not form the prior art that is already known in this country to a person of ordinary skill in the art.

SUMMARY OF THE INVENTION

In certain preferred aspects, the present invention features an ignition coil of an engine, in which a small condenser is directly installed to a low voltage (LV) pin of the ignition coil to effectively remove noise, a cover having waterproof and breathable fiber suitably inserted through insert molding that is suitably applied to dissipate heat from the ignition coil to an outside and suitably prevent the inflow of water, a ground pin is added to the LV pin and the ground pin is suitably connected to a vehicle body or a head cover of the engine to be grounded, thus enhancing the noise removal effect.

Preferably, in certain embodiments of the present invention, an ignition coil is preferably mounted to a head cover of an engine to supply high voltage to a spark plug in the engine. Preferably, the ignition coil includes an outer casing defining the external appearance of the ignition coil. In certain preferred embodiments, a first spool is inserted into the outer casing, and a second spool is provided in the first spool. Preferably, a LV pin is provided on the upper portion of the first spool. Further, preferably a condenser is provided on the LV pin. Preferably, a cover is provided to cover the upper portion of the outer casing and manufactured through injection molding such that waterproof and breathable fiber dissipating heat from the condenser to an outside and preventing inflow of water from the outside is inserted into the cover.

In certain preferred embodiments, the LV pin may include a signal pin connected to a control unit of the engine, a power pin connected to a battery, and a ground pin for grounding, and the condenser may preferably be connected to the signal pin.

Preferably, a protruding part may be provided on the upper portion of the outer casing, and a ground bolt may be fastened to the protruding part to be connected to a vehicle body or the head cover of the engine, and the ground bolt may be connected to the ground pin.

As is apparent from the above description, an ignition coil of an engine according to the present invention has certain advantages in that a small condenser is directly installed to an LV pin of the ignition coil to effectively remove noise, a cover having waterproof and breathable fiber (e.g., Gore-Tex) inserted through insert molding is suitably applied to effectively dissipate heat from the ignition coil to an outside and prevent the inflow of water, a ground pin is added to the LV pin and the ground pin is suitably connected to a vehicle body or a head cover of the engine to be grounded, thus suitably enhancing the noise removal effect.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more clearly understood from the following detailed description when taken in conjunction with the accompanying drawings, in which.

It should be understood that the appended drawings are not necessarily to scale, presenting a somewhat simplified representation of various preferred features illustrative of the basic principles of the invention. The specific design features of the present invention as disclosed is herein, including, for example, specific dimensions, orientations, locations, and shapes will be determined in part by the particular intended application and use environment.

DETAILED DESCRIPTION OF THE INVENTION

As described herein, the present invention features an ignition coil of an engine comprising an outer casing, first spool inserted into the outer casing, a second spool provided in the first spool, a low voltage (LV) pin, a condenser provided on the LV pin, and a cover provided to cover an upper portion of the outer casing.

In one preferred embodiment, the ignition coil is mounted to a head cover of the engine to supply high voltage to a spark plug in the engine.

In another preferred embodiment, the outer casing defines an external appearance of the ignition coil.

In another further preferred embodiment, a low voltage (LV) pin is provided on an upper portion of the first spool.

In still another preferred embodiments, the cover is provided to cover an upper portion of the outer casing.

In one preferred embodiment, the cover is manufactured through injection molding such that waterproof and breathable fiber dissipating heat from the condenser to an outside and preventing inflow of water from the outside is inserted into the cover.

Hereinafter, an ignition coil of an engine according to preferred embodiments of the present invention will be described with reference to the accompanying drawings.

Figure 2:
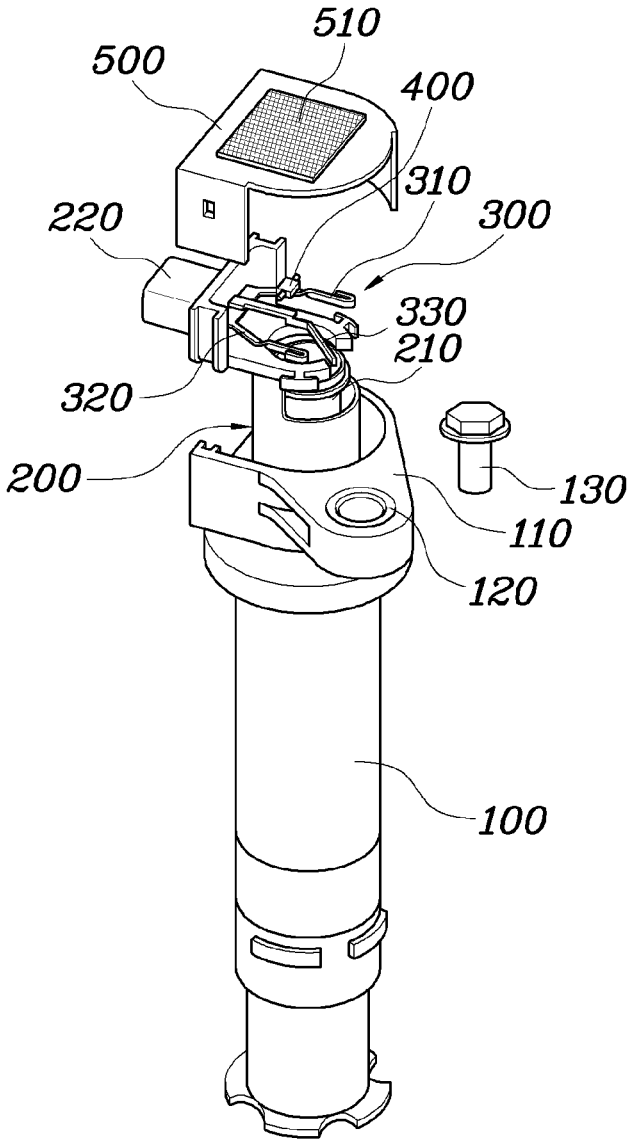
FIG. 2 is a perspective view illustrating an ignition coil of an engine according to an embodiment of the present invention.

In certain preferred embodiments, and referring to FIG. 2 for example, the ignition coil of the engine according to preferred embodiments of the present invention is suitably mounted to a head cover of the engine to supply high voltage to spark plugs in the engine, and preferably includes an outer casing 100, a first spool 200, a second spool 210, an LV pin 300, a condenser 400, and a cover 500.

Figure 1:
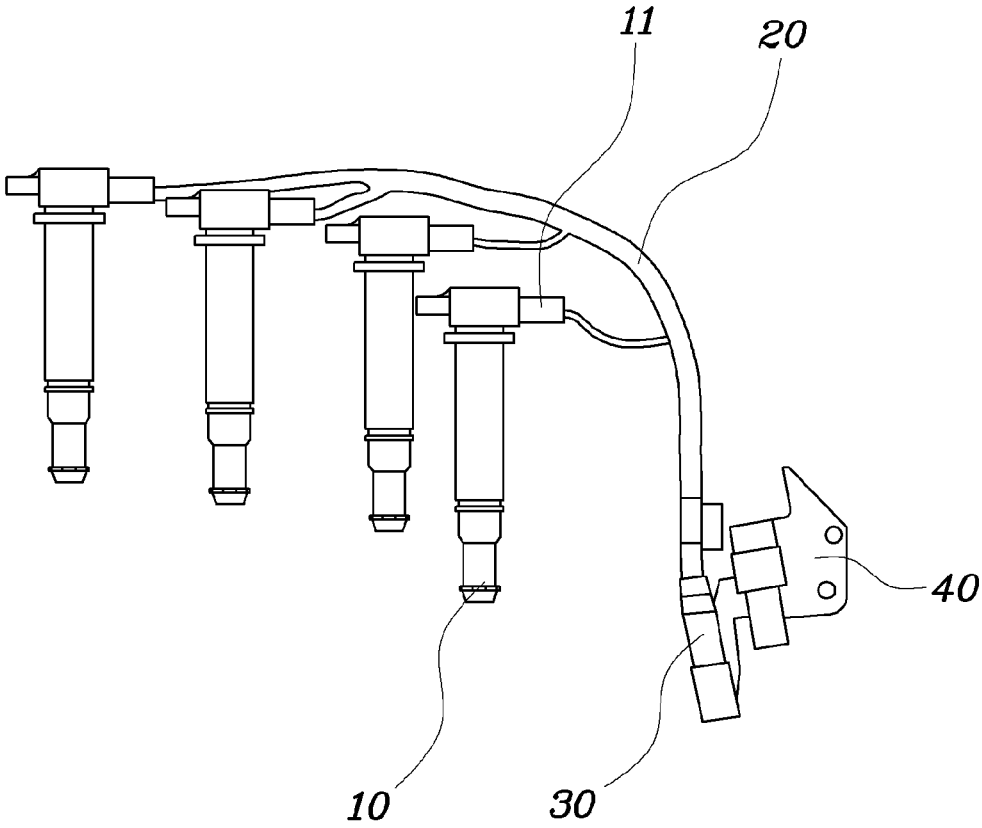
FIG. 1 is a view illustrating a conventional connecting relation between an ignition coil and a condenser.

In certain preferred embodiments, the outer casing 100 has a cylindrical shape. Preferably, the first spool 200 is suitably inserted into the outer casing 100, and a connector 220 is integrally provided on the upper portion of the first spool 200 to connect the ignition coil to the wiring harness 20 (see FIG. 1). In further preferred embodiments, a first coil (not shown) is preferably wound around the outer circumference of the first spool 200.

In further embodiments of the present invention, the second spool 210 is inserted into the first spool 200. Preferably, a second coil (not shown) is wound around the outer circumference of the second spool 210, and a magnetic core (not shown) is suitably installed in the second spool 210.

In further preferred embodiments, the ignition coil constructed as described above induces high voltage by electromagnetic induction between the first and second coils and electromagnetic induction between the first coil and the magnetic core, and supplies the induced high voltage to the spark plugs.

Further, the LV pin 300 preferably receives a signal which is suitably input from a control unit of the engine, and receives power which is suitably supplied from a power supply unit. Preferably, the LV pin 300 includes a signal pin 310 that is suitably connected to the engine control unit, and a power pin 320 suitably connected to the power supply unit. Preferably, the LV pin 300 further includes a ground pin 330 for grounding. Here, the ground pin 330 is preferably positioned between the signal pin 310 and the power pin 320.

According to certain preferred embodiments, the condenser 400 removes ignition noise generated from the ignition coil and other noise generated and transferred from an outside. Preferably, the condenser 400 is suitably manufactured to be of a small size and connected to the signal pin 310.

According to exemplary embodiments of the present invention, the reason why the condenser 400 is connected to the signal pin 310 is because the removal of noise from the surroundings of the signal pin 310 is more effective than that from the surroundings of the power pin 320 or the ground pin 330. However, since the amount of heat transferred from the engine to the signal pin 310 is larger than that of heat transferred from the engine to the power pin 320, the thermal stress acting on the condenser 400 has to be suitably lessened. Preferably, then, for this reason, the cover 500 is manufactured through injection molding such that waterproof and breathable fiber 510 is suitably inserted into the cover 500. Preferably, the cover 500 is suitably installed to cover the upper portion of the outer casing 100, and the waterproof and breathable fiber 510 is suitably inserted into the cover 500 functions to dissipate heat from the condenser 400 to an outside, in addition to preventing the inflow of water from the outside.

Further, a protruding part 110 is suitably provided on the upper portion of the outer casing 100, with a bushing 120 suitably installed in the protruding part 110. Preferably, a ground bolt 130 is suitably fastened to the bushing 120 and connected to a vehicle body or the head cover of the engine to be grounded (negative polarity). Preferably, the ground bolt 130 is suitably connected to the ground pin 330 at the shortest distance, thus removing noise so that it is not transmitted along the condenser 400 to another part.

As described herein, the present invention provides an ignition coil of an engine, in which a small condenser is directly installed to an UV pin of the ignition coil to effectively remove noise, a cover having waterproof and breathable fiber suitably inserted through insert molding is applied to effectively dissipate heat from the ignition coil to an outside and prevent the inflow of water, a ground pin is preferably added to the LV pin and the ground pin is suitably connected to a vehicle body or a head cover of the engine to be grounded, thus suitably enhancing the noise removal effect.

Although certain preferred embodiments of the present invention have been described for is illustrative purposes, those skilled in the art will appreciate that various modifications, additions and substitutions are possible, without departing from the scope and spirit of the invention as disclosed in the accompanying claims.

What is claimed is:

1. An ignition coil of an engine mounted to a head cover of the engine to supply high voltage to a spark plug in the engine, the ignition coil comprising:

an outer casing defining an external appearance of the ignition coil;

a first spool inserted into the outer casing, with a second spool being provided in the first spool;

a low voltage (LV) pin provided on an upper portion of the first spool;

a condenser provided on the LV pin and configured to generate heat; and a cover provided to cover an upper portion of the outer casing having a central portion including a waterproof and breathable fabric injection molded thereto to dissipate heat from the condenser outside while at the same time preventing an inflow of water.

2. The ignition coil of claim 1, wherein the LV pin comprises a signal pin connected to a control unit of the engine, a power pin connected to a battery, and a ground pin for grounding, and the condenser is connected to the signal pin.

3. The ignition coil of claim 2, wherein a protruding part is provided on the upper portion of the outer casing, and a ground bolt is fastened to the protruding part to be connected to a vehicle body or the head cover of the engine, and the ground bolt is connected to the ground pin.

4. An ignition coil of an engine comprising:

an outer casing;

a first spool inserted into the outer casing, a second spool provided in the first spool;

a low voltage (LV) pin;

a condenser provided on the LV pin; and a cover provided to cover an upper portion of the outer casing, wherein the LV pin comprises a signal pin connected to a control unit of the engine, a power pin connected to a battery, and a ground pin for grounding, and the condenser is connected to the signal pin, wherein the cover has a central portion including a waterproof and breathable fabric injection molded thereto to dissipate heat from the condenser outside while at the same time preventing an inflow of water.

5. The ignition coil of an engine of claim 4, wherein the ignition coil is mounted to a head cover of the engine to supply high voltage to a spark plug in the engine.

6. The ignition coil of an engine of claim 4, wherein the outer casing defines an external appearance of the ignition coil.

7. The ignition coil of an engine of claim 4, wherein the a low voltage (LV) pin is provided on an upper portion of the first spool.

8. The ignition coil of an engine of claim 4, wherein the cover is provided to cover an upper portion of the outer casing.

* * * * *